United States Patent [19]

Brown

[11] 4,024,595

[45] May 24, 1977

[54] LINKAGE BRIDGE

[76] Inventor: James Brown, 2950 Iris Ave., San Diego, Calif. 92154

[22] Filed: May 21, 1976

[21] Appl. No.: 688,713

[52] U.S. Cl. ..... 14/1; 182/40; 14/27

[51] Int. Cl.[2] ..... E01D 1/00

[58] Field of Search ..... 14/1, 27; 182/40, 41

[56] References Cited

UNITED STATES PATENTS

| | | | |
|---|---|---|---|
| 519,499 | 5/1894 | Ellis | 182/41 |
| 543,750 | 7/1895 | Painter | 182/41 |
| 736,104 | 8/1903 | Hubartt | 182/41 |
| 2,987,024 | 6/1961 | Rush | 14/27 X |
| 3,397,546 | 8/1968 | Eisert | 182/40 X |
| 3,420,331 | 1/1969 | Minnite | 14/27 X |
| 3,458,884 | 8/1969 | Gurganious | 14/27 |
| 3,523,318 | 8/1970 | McGuinness | 14/27 |

*Primary Examiner*—Nile C. Byers, Jr.
*Attorney, Agent, or Firm*—Ralph S. Branscomb

[57] ABSTRACT

A linkage bridge consisting of a plurality of links rotatably coupled to form an elongated structural platform, each having a rotational stop to form an elongated structural platform and being rotatably coupled for being taken up and carried by a reel which can be mounted on a truck bed, for example. Each of the link members having a bracket on the bottom side thereof for the passage through of a structural rod when the links are paid out in a linear platform configuration. The links at the reel end being passed through a structural guide for lending further structural strength and rigidity thereto.

5 Claims, 5 Drawing Figures

LINKAGE BRIDGE

PRIOR ART

The following patents were discovered in a preliminary search:

| U.S.Pat. No. | Inventor |
|---|---|
| 3,420,331 | R. Minnite |
| 951,379 | A. Norman |
| 2,987,024 | P. J. Rush |

BRIEF DESCRIPTION OF THE INVENTION

According to the invention, a linkage bridge is provided in which a plurality of link members are rotatably coupled to each other in an end-to-end fashion forming an elongated structural platform. Each of the rotational couplings has a rotational stop attendent therewith so that at the limit of rotation in a horizontal position, the linkage members form linear elongated structural platform for bridging streams, crevices, etc. When it is desired to store or move the linkage bridge, the links are rolled up on a reel which can be mounted on a truck bed, for example. A guide is provided through which the linkages pass for lending structural strength and rigidity at the reel end. A motor is coupled to the reel for rotation thereof and to a gear wheel which is coupled to the linkages and forces them to turn in either a pay-out or a take-up movement. A further reel can be provided carrying a cable which can be attached, for example, to the first linkage and coupled to the motor for paying out as the linkage bridge extends to decrease vibration. Each of the linkage members is preferably provided with an eye bracket extending downwardly therefrom for the slidable reception of a reinforcement rod after the linkage bridge is paid out to the desired length. The entire mechanism can be mounted on a truck or trailer bed for portability purposes.

An object of the present invention is the provision of an improved linkage bridge.

Another object of the invention is the provision of a linkage bridge which is totally portable.

A further object of the invention is the provision of a linkage bridge which is structurally strong.

Other objects and many of the attendent advantages of the present invention will be readily appreciated as the same becomes better understood by reference to the following detailed description when considered in connection with the accompanying drawings in which like reference numerals designate like parts throughout the Figures thereon and wherein.

DETAILED DESCRIPTION OF THE DRAWINGS

Figure 1:
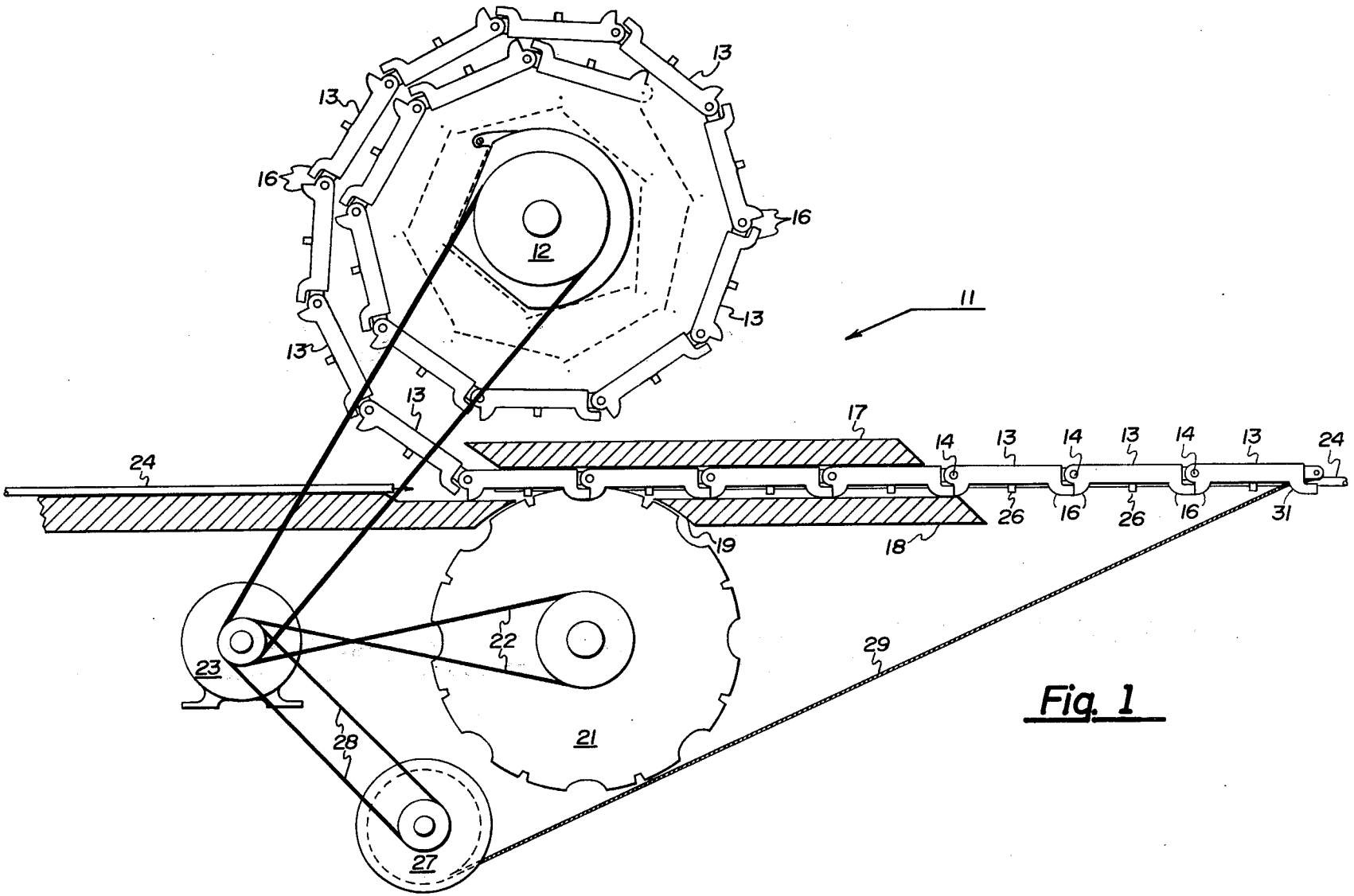
FIG. 1 is a side elevational view partially in cross-section of the preferred embodiment of the present invention.
Figure 2:
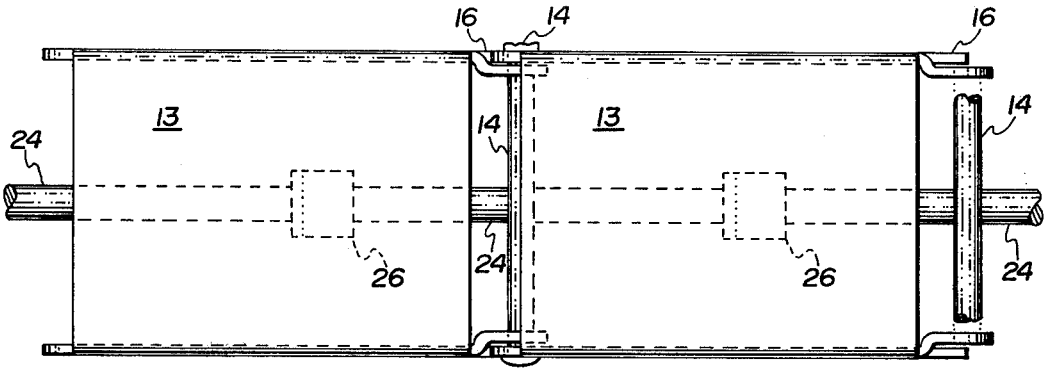
FIG. 2 is a top view of two of the linkage members of FIG. 1.
Figure 3:
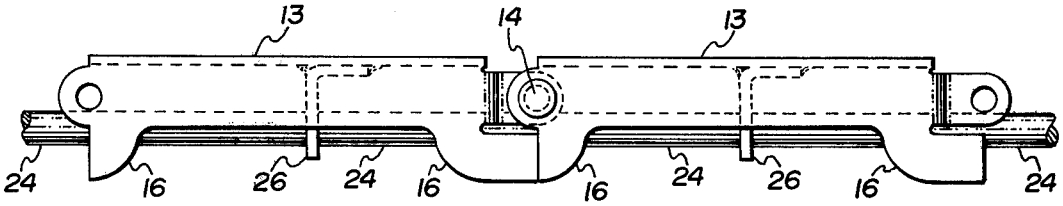
FIG. 3 is a side elevational view of two of the linkage members of FIG. 1.
Figure 4:
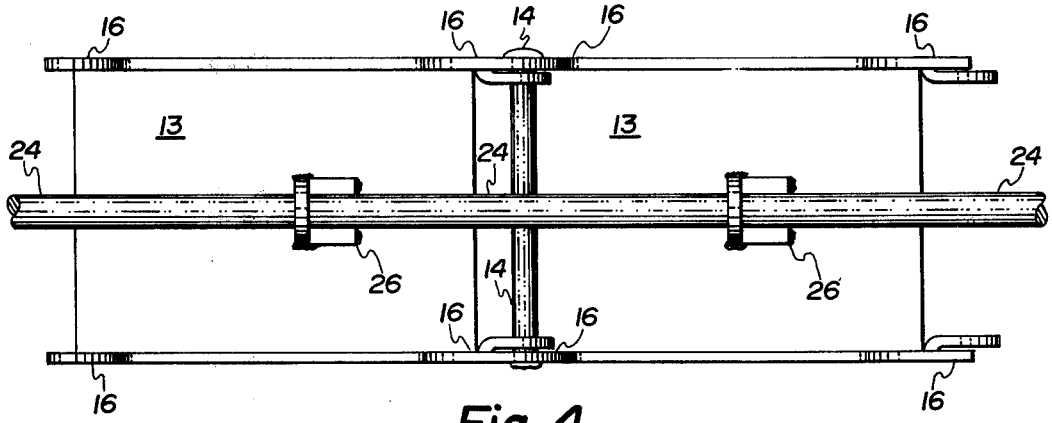
FIG. 4 is a bottom view of two of the linkage members of FIG. 1.
Figure 5:
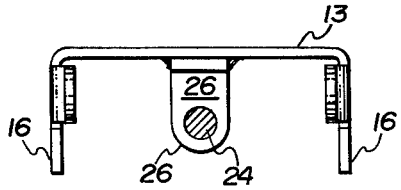
FIG. 5 is an end elevational view of one linkage member of the embodiment of FIG. 1.

Referring to FIG. 1, the preferred embodiment of the linkage bridge assembly is shown generally at 11 having a reel 12 carrying a plurality of linkage members 13 thereon. Linkage members 13 are rotatably coupled together by axles 14 and have rotational stop extensions 16 on each end thereof.

Linkage members 13 pass through guide members 17 and 18. Guide member 18 has an aperture 19 for allowing gear wheel 21 with recesses 22 therein to contact rotational stops 16. Gear wheel 21 is coupled for rotation at 22 to motor 23. Reinforcement rod 24 is positioned for insertion through eye brackets 26 extending downwardly from linkage members 13. Cable reel 27 is coupled to motor 23 at 28 and carries cable 29 which is attached to a front linkage member at 31.

Referring to FIGS. 2, 3, 4, and 5, linkage members 13 have downwardly extending eye brackets 26 slidably carrying reinforcement rod 24. Linkage members 13 are rotationally coupled together via axles 14 and have rotational stops 16 extending downwardly therefrom and in abutment with each other.

OPERATION

Referring to all of the Figures and particularly to FIG. 1, the operation will be described. When it is desired to pay out the linkage members from reel 12, motor 23 is energized, rotating reel 12 counterclockwise and gear reel 21 clockwise. Gear reel 21 through recesses 22 contacts rotational stop extension 16 and pulls the linkage members to the right of the drawing through guide members 17 and 18. As this is taking place, cable reel 27 is rotating clockwise paying out cable 29 which is attached at its end at 31 to the end linkage member, this holds the linkage members steady during the paying out process; and, also, of course, is a means of transporting a cable across a precipice when so desired. Guide members 17 and 18 lend structural strength at the reel end of the bridge to eliminate stress on reel 12 and gear reel 21. After the sufficient number of linkage members have been paid out for the desired length of bridge, a reinforcement rod 24 is passed through eye brackets 26 which are shown extending downwardly from each of the linkage members 13. This adds further strength and rigidity to the linkage bridge. When it is desired to retract the bridge reinforcement rod 24 is withdrawn and motor 23 energized in an opposite rotational direction, which rotates reel 12 in a clockwise direction and gear reel 21 in a counterclockwise direction and at the same time rotates cable reel 27 in a counterclockwise direction.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

The invention claimed is:

1. A linkage bridge comprising:

a plurality of link members rotatably coupled in an end-to-end relationship forming an elongated structural platform;

rotational stop means between each adjacent link member forming a rotational stop and resulting in a flat linear structural platform at one extreme of rotation between each adjacent link member;

a reel coupled to an end link member and operable for rotationally taking up all of said link members for storing and transporting;

first and second structural guide members disposed above and below said linkage members, said guide members defining an elongated rectilinear guiding for said linkage members and being operable for lending structural strength and rigidity to paid-out linkage members, said first and second guide members disposed in proximity to said reel such that the protruded end of said linkage bridge is self-supporting without auxiliary support members; and a drive wheel coupled to said linkage members, said drive wheel operable for paying out and taking up said linkage members.

2. The linkage bridge of claim 1 and further including:

a bracket extending downwardly from each of said linkage members, said bracket having an aperture therein, and a structural rod dimensioned for being slidably received by the apertures of a plurality of brackets of consecutive linkage members when said linkage members are in a paid-out position.

3. The linkage bridge of claim 1 wherein said rotaional stops depend from said link members and said drive wheel includes circumferential structure cooperating with said stops to positively engage same to insure positive slip-free paying out of said linkage bridge.

4. Structure according to claim 1 wherein said second structural guide is interrupted by an access opening through which said drive wheel operatively engages said linkage bridge.

5. Structure according to claim 2 wherein said second structure guide member disposes below said linkage members has a raised platform to the rear of the upper platform and in general alignment with the lower edges of the apertures in said brackets to guide said rod into said brackets.

* * * * *